US010683633B2

(12) United States Patent
Voelz et al.

(10) Patent No.: US 10,683,633 B2
(45) Date of Patent: Jun. 16, 2020

(54) CONTROLLING CROWD RUNAWAY OF AN INDUSTRIAL MACHINE

(71) Applicant: Harnischfeger Technologies, Inc., Wilmington, DE (US)

(72) Inventors: Nicholas R. Voelz, West Allis, WI (US); Michael Linstroth, Port Washington, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 289 days.

(21) Appl. No.: 15/728,190

(22) Filed: Oct. 9, 2017

(65) Prior Publication Data

US 2018/0030688 A1 Feb. 1, 2018

Related U.S. Application Data

(62) Division of application No. 14/695,268, filed on Apr. 24, 2015, now Pat. No. 9,809,949.

(60) Provisional application No. 61/984,322, filed on Apr. 25, 2014.

(51) Int. Cl.

| | |
|---|---|
| ***E02F 3/43*** | (2006.01) |
| ***E02F 9/20*** | (2006.01) |
| ***E02F 9/26*** | (2006.01) |
| ***E02F 3/30*** | (2006.01) |
| ***E02F 3/46*** | (2006.01) |

(52) U.S. Cl.

CPC ..... *E02F 3/435* (2013.01); *E02F 9/2033* (2013.01); *E02F 9/265* (2013.01); *E02F 3/304* (2013.01); *E02F 3/308* (2013.01); *E02F 3/46* (2013.01)

(58) Field of Classification Search

CPC ..... E02F 3/435; E02F 9/265; E02F 9/2033; E02F 3/46; E02F 3/304; E02F 3/308

USPC ..... 701/50

See application file for complete search history.

(56) References Cited

U.S. PATENT DOCUMENTS

| | | | |
|---|---|---|---|
| 6,014,598 | A | 1/2000 | Duyar et al. |
| 6,194,856 | B1 | 2/2001 | Kobayashi et al. |
| 6,297,610 | B1 | 10/2001 | Bauer et al. |

(Continued)

FOREIGN PATENT DOCUMENTS

| | | |
|---|---|---|
| CN | 101680204 | 3/2010 |
| CN | 102535556 | 7/2012 |

(Continued)

OTHER PUBLICATIONS

Rockwell Automation, "Intelligent Motor Control: The Piece That Helps Make it Come Together," brochure (2008) pp. 1-132, USA.

(Continued)

*Primary Examiner* — Abby Y Lin
*Assistant Examiner* — Pum H Thang
(74) *Attorney, Agent, or Firm* — Michael Best & Friedrich LLP

(57) ABSTRACT

A system for controlling the operation of an industrial machine during crowd runaway conditions. The system includes a controller that monitors and compares an actual crowd system state (e.g., an actual dipper position) with a requested crowd system state (e.g., a requested dipper position from the operator). If the controller determines that the crowd system is behaving contrary to requested crowd system behavior, the controller adjusts a crowd parameter, such as a crowd motor torque, to resolve the runaway condition.

15 Claims, 6 Drawing Sheets

(56) References Cited

U.S. PATENT DOCUMENTS

| | | | | |
|---|---|---|---|---|
| 6,338,024 | B1 | 1/2002 | Taniguchi et al. | |
| 6,704,875 | B1 | 3/2004 | Kinoshita et al. | |
| 7,894,917 | B2 | 2/2011 | Weatherhead et al. | |
| 8,214,455 | B2 | 7/2012 | Baier et al. | |
| 8,229,575 | B2 | 7/2012 | Vasko et al. | |
| 8,463,508 | B2 | 6/2013 | Nicholson et al. | |
| 8,509,935 | B2 | 8/2013 | Hoyte et al. | |
| 9,809,949 | B2 | 11/2017 | Voelz et al. | |
| 2007/0191968 | A1 | 8/2007 | Sikka et al. | |
| 2008/0282583 | A1 | 11/2008 | Koellner et al. | |
| 2011/0153091 | A1 | 6/2011 | Nicholson et al. | |
| 2011/0282630 | A1 | 11/2011 | Rikkola et al. | |
| 2012/0092180 | A1 | 4/2012 | Rikkola et al. | |
| 2012/0158012 | A1 | 6/2012 | Sandhu et al. | |
| 2012/0277959 | A1* | 11/2012 | Colwell | E02F 3/46 701/50 |
| 2012/0310494 | A1* | 12/2012 | Asami | B60W 10/30 701/50 |
| 2013/0193894 | A1 | 8/2013 | Kiguchi et al. | |
| 2013/0234642 | A1 | 9/2013 | Igarashi et al. | |
| 2013/0241460 | A1 | 9/2013 | Ushiyama et al. | |
| 2013/0249336 | A1 | 9/2013 | Voelz et al. | |
| 2014/0236432 | A1 | 8/2014 | Haisler et al. | |
| 2015/0020452 | A1 | 1/2015 | Chen | |
| 2015/0308073 | A1 | 10/2015 | Voelz et al. | |

FOREIGN PATENT DOCUMENTS

| | | |
|---|---|---|
| CN | 103362170 | 10/2013 |
| JP | S60-167003 | 8/1985 |
| WO | 2012148436 A1 | 11/2012 |
| WO | 2012148437 A1 | 11/2012 |

OTHER PUBLICATIONS

Examination Report issued by the Australian Patent Office for related Application No. 2015202126 dated Oct. 22, 2018 (5 pages).

Chilean Patent Office Action for Application No. 2015-001080 dated Dec. 13, 2017 (7 pages including Statement of Relevance).

Office Action issued by the Chinese Patent Office for related Application No. 201510205429.9 dated Jun. 20, 2018 (6 pages including Statement of Relevance).

* cited by examiner

CONTROLLING CROWD RUNAWAY OF AN INDUSTRIAL MACHINE

RELATED APPLICATIONS

This application is a division of U.S. patent application Ser. No. 14/695,268, filed Apr. 24, 2015, which claims the benefit of U.S. Provisional Patent Application No. 61/984,322, filed Apr. 25, 2014, the entire contents of both of which are hereby incorporated by reference.

BACKGROUND

This invention relates to controlling the operation of an industrial machine, such as an electric rope or power shovel.

SUMMARY

Industrial machines, such as electric rope shovels, are used to execute digging operations to remove material from, for example, a bank of a mine. During the normal operation of a rope shovel, there are occasions when the operator exits the bank with a full or excessively full dipper (i.e., a larger-than-normal payload). The fullness of the dipper can affect the radial position/movement of the dipper with respect to the machine (e.g., crowd motion) while swinging the dipper toward a dump site. For example, as the dipper swings toward the dump site, the swing speed and the resultant centrifugal forces on the dipper can force the dipper outward, such that the position of the dipper cannot be completely controlled by the operator. When the operator is unable to control the motion of the dipper in a desired manner due to such external forces, the crowd system is considered to be "running away." In addition to causing potential damage to the industrial machine, crowd system runaway can affect shovel cycle times by increasing the time required to swing the dipper from the excavation site to the dump site and back.

Embodiments of the invention provide a system for controlling the operation of an industrial machine during crowd runaways conditions. The system includes a controller that monitors and compares an actual crowd system state (e.g., an actual dipper position) with a requested crowd system state (e.g., a requested dipper position from the operator). If the controller determines that the actual crowd system is behaving contrary to requested crowd system behavior, the controller adjusts a crowd parameter, such as a crowd motor torque, to resolve the runaway condition. If the crowd runaway condition cannot be resolved by adjusting the crowd parameter, the controller can perform further actions, such as setting the brakes for one or more system motors.

In one embodiment, the invention provides an industrial machine that includes a dipper, a sensor, a user interface, a crowd motor having at least one operating parameter, and a controller. The sensor generates a first signal related to an actual crowd system state, which is received by the controller. The user interface generates a second signal related to a requested crowd system state based on an operator input, which is received by the controller. The controller determines a difference between the requested crowd system state and the actual crowd system state, and compares the difference to a threshold. The controller sets the at least one operating parameter of the crowd motor to a value when the difference is greater than or equal to the threshold. The value is greater than a normal operating value for the operating parameter.

In another embodiment, the invention provides a method for controlling a motor of an industrial machine. The industrial machine includes a processor that receives a first signal related to an actual crowd system state, and a second signal related to a requested crowd system state. The method includes determining a difference between the requested crowd system state and the actual crowd system state, and comparing the difference to a threshold. The method also includes setting the at least one operating parameter of the motor to a value when the difference is greater than or equal to the threshold. The value is greater than a normal operating value for the operating parameter.

In another embodiment, the invention provides an industrial machine that includes a dipper, a sensor, a user interface, a crowd motor having at least one operating parameter, and a controller. The sensor generates a first signal related to an actual crowd system state, which is received by the controller. The user interface generates a second signal related to a requested crowd system state based on an operator input, which is received by the controller. The controller determines a requested dipper movement direction based on the second signal, and determines an actual dipper movement direction based on the first signal. The controller determines whether the requested dipper movement direction and the actual dipper movement direction are the same. The controller sets the at least one operating parameter of the crowd motor to a value when the requested dipper movement direction is not the same as the actual dipper movement direction. The value is greater than a normal operating value for the operating parameter.

In another embodiment, the invention provides a method for controlling a motor of an industrial machine. The industrial machine includes a processor that receives a first signal related to an actual crowd system state, and a second signal related to a requested crowd system state. The method also includes determining a requested dipper movement direction based on the second signal, and determining an actual dipper movement direction based on the first signal. The method includes determining whether the requested dipper movement direction and the actual dipper movement direction are the same. The method also includes setting at least one operating parameter of the motor to a value when the requested dipper movement direction is not the same as the actual dipper movement direction. The value is greater than a normal operating value for the operating parameter.

Before any embodiments of the invention are explained in detail, it is to be understood that the invention is not limited in its application to the details of the configuration and arrangement of components set forth in the following description or illustrated in the accompanying drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments of the invention may include hardware, software, and electronic components or modules that, for purposes of discussion, may be illustrated and described as if the majority of the components were implemented solely in hardware.

However, one of ordinary skill in the art, and based on a reading of this detailed description, would recognize that, in at least one embodiment, the electronic based aspects of the invention may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components may be utilized to implement the invention. For example, "servers" and "computing devices" described in the specification can include one or more processing units, one or more computer-readable medium modules, one or more input/output interfaces, and various connections (e.g., a system bus) connecting the components.

Other aspects of the invention will become apparent by consideration of the detailed description and accompanying drawings.

DETAILED DESCRIPTION

The invention described herein relates to systems, methods, devices, and computer readable media associated with the dynamic control of an industrial machine (e.g., controlling one or more settings or parameters of the industrial machine). The industrial machine, such as an electric rope shovel or similar mining machine, is operable to execute a digging operation to remove a payload (e.g., material, etc.) from a bank. During the execution of a digging operation, the forces exerted on the dipper and dipper handle of the industrial machine vary with, for example, a weight of a load in the dipper, an amount of applied crowd force, an amount of force from swinging, etc. Under certain conditions, such as in a runaway condition, it is possible to lose control of the dipper movement such that actual dipper movement does not correspond to an operator-requested dipper movement. In order to prevent such a situation, a control system of the industrial machine is configured to dynamically control a parameter (e.g., crowd force, crowd motor torque, crowd motor speed, swing motor speed, etc.) related to resolving the runaway condition and aligning the actual direction of movement of the dipper with the requested direction of movement of the dipper. Such control is achieved by regulating, for example, the force or power that is applied to the dipper.

As an illustrative example, to resolve a crowd runaway condition, a torque (e.g., a motor torque, a retract torque, a crowd torque, a crowd retract torque, etc.) can be set to compensate for the difference between an actual and requested parameter (e.g., a dipper position relative to the shovel, a crowd motor speed, etc.). In other embodiments, a crowd force (e.g., a hydraulic crowd force) can be set to compensate for the difference between the actual and requested parameter. The amount of force or torque applied can be set to a fixed value, set to a value proportional (e.g., linearly, nonlinearly, etc.) to the difference between the actual and requested crowd parameters, calculated as a function of the difference, accessed from memory, etc. For example, the value for the force or torque can be determined as a ratio of the actual parameter to the requested parameter. As such, the industrial machine can momentarily modify (e.g., increase or decrease) its performance to resolve the crowd runaway condition.

Figure 1:
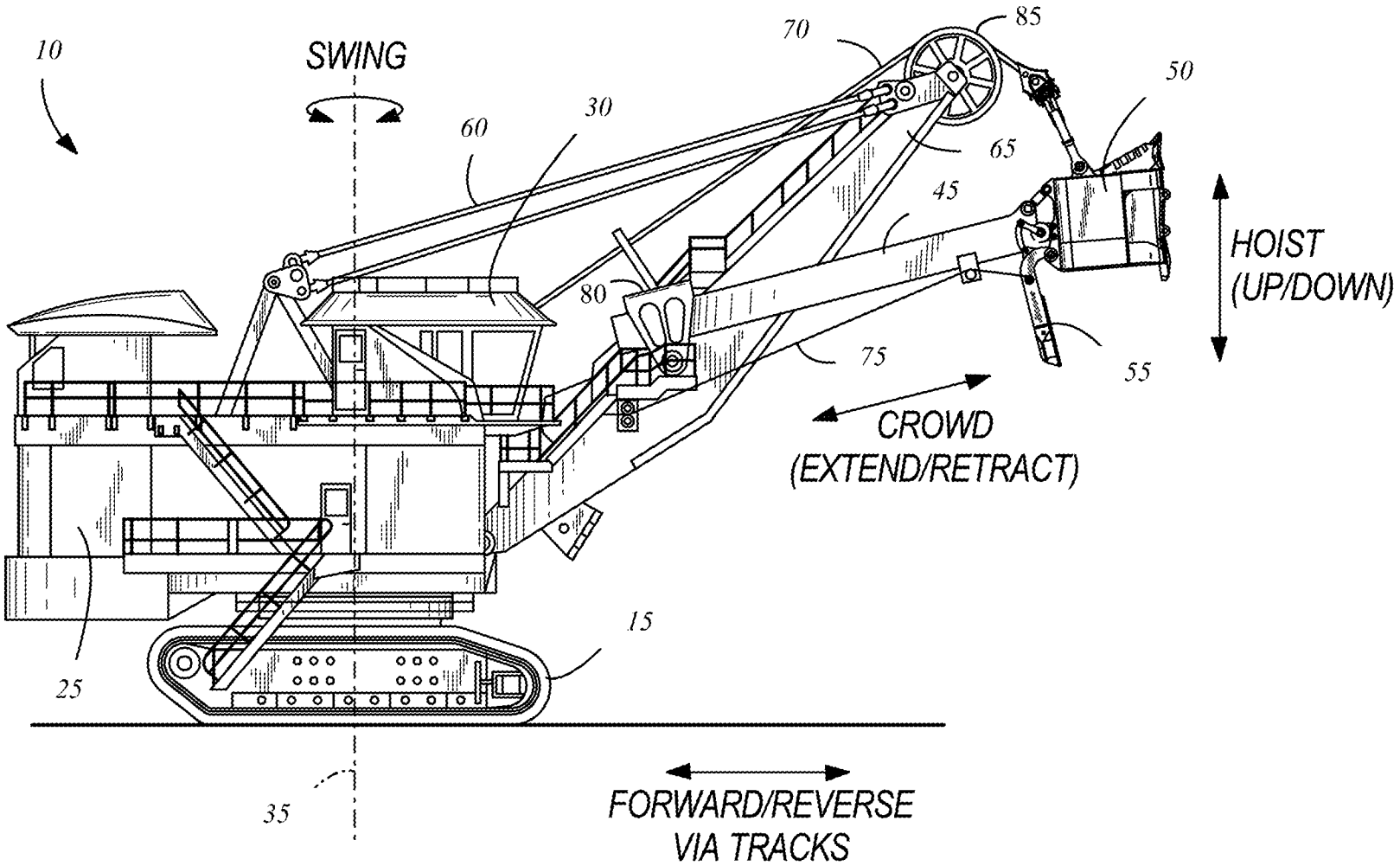
FIG. 1 illustrates an industrial machine according to an embodiment of the invention.

Although the invention described herein can be applied to, performed by, or used in conjunction with a variety of industrial machines (e.g., a rope shovel, a dragline, AC machines, DC machines, etc.), embodiments of the invention described herein are described with respect to an electric rope or power shovel, such as the power shovel 10 shown in FIG. 1. The power shovel 10 includes tracks 15 for propelling the shovel 10 forward and backward, and for turning the rope shovel 10 (i.e., by varying the speed and/or direction of left and right tracks relative to each other). The tracks 15 support a base 25 including a cab 30. The base 25 is able to swing or swivel about a swing axis 35, for instance, to move from a digging location to a dumping location. Movement of the tracks 15 is not necessary for the swing motion. The rope shovel 10 further includes a pivotable dipper handle 45 and dipper 50. The dipper 50 includes a door 55 for dumping contents of the dipper 50.

The rope shovel 10 includes suspension cables 60 coupled between the base 25 and a boom 65 for supporting the boom 65. The rope shovel also include a wire rope or hoist cable 70 attached to a winch and hoist drum within the base 25 for winding the hoist cable 70 to raise and lower the dipper 50, and a dipper trip cable 75 connected between another winch (not shown) and the dipper door 55. The rope shovel 10 also includes a saddle block 80 and a sheave 85. In some embodiments, the rope shovel 10 is a P&H® 4100 series shovel produced by Joy Global Inc.

Figure 2:
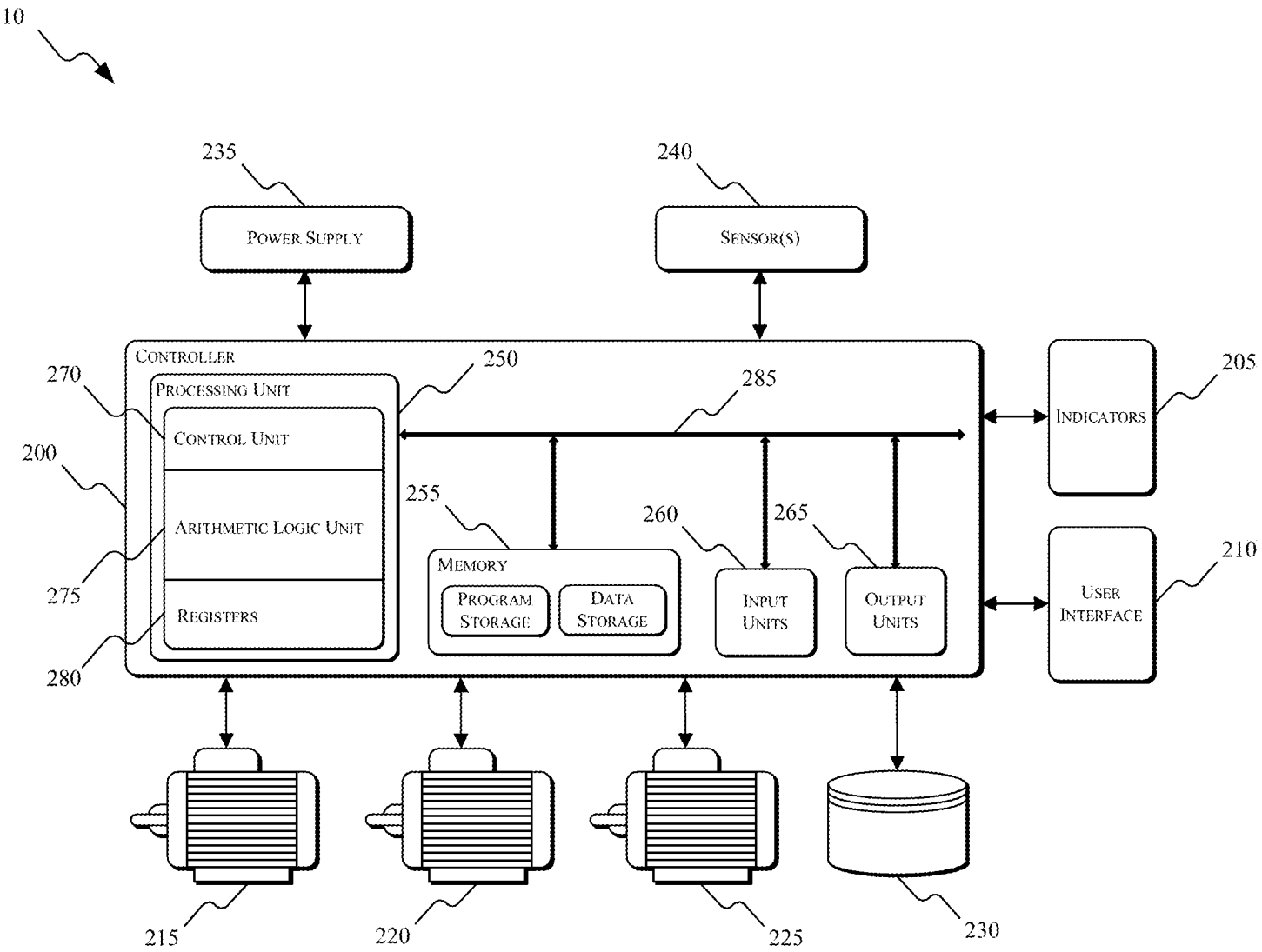
FIG. 2 illustrates a control system of the industrial machine of FIG. 1 according to an embodiment of the invention.

FIG. 2 illustrates a controller 200 associated with the shovel 10 of FIG. 1. The controller 200 is electrically and/or communicatively connected to a variety of modules or components of the shovel 10. For example, the illustrated controller 200 is connected to one or more indicators 205, a user interface module 210, one or more hoist actuators or motors and hoist drives 215, one or more crowd actuators or motors and crowd drives 220, one or more swing actuators or motors and swing drives 225, a data store or database 230, a power supply module 235, and one or more sensors 240. The controller 200 includes combinations of hardware and software that are operable to, among other things, control the operation of the power shovel 10, control the position of the boom 65, the dipper handle 45, the dipper 50, etc., activate the one or more indicators 205 (e.g., a liquid crystal display ["LCD"]), monitor the operation of the shovel 10, etc. The one or more sensors 240 include, among other things, a loadpin strain gauge, one or more inclinometers, gantry pins, one or more motor field modules, one or more resolvers, etc. In some embodiments, a crowd drive other than a crowd drive for a motor can be used (e.g., a crowd drive for a single legged handle, a stick, a hydraulic cylinder, etc.).

In some embodiments, the controller 200 includes a plurality of electrical and electronic components that provide power, operational control, and protection to the components and modules within the controller 200 and/or shovel 10. For example, the controller 200 includes, among other things, a processing unit 250 (e.g., a microprocessor, a microcontroller, or another suitable programmable device), a memory 255, input units 260, and output units 265. The processing unit 250 includes, among other things, a control unit 270, an arithmetic logic unit ("ALU") 275, and a plurality of registers 280 (shown as a group of registers in FIG. 2), and is implemented using a known computer architecture, such as a modified Harvard architecture, a von Neumann architecture, etc. The processing unit 250, the memory 255, the input units 260, and the output units 265, as well as the various modules connected to the controller 200 are connected by one or more control and/or data buses (e.g., common bus 285). The control and/or data buses are shown generally in FIG. 2 for illustrative purposes. The use of one or more control and/or data buses for the interconnection between and communication among the various modules and components would be known to a person skilled in the art in view of the invention described herein. In some embodiments, the controller 200 is implemented partially or entirely on a semiconductor chip, is a field-programmable gate array ("FPGA"), is an application specific integrated circuit ("ASIC"), etc.

The memory 255 includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processing unit 250 is connected to the memory 255 and executes software instructions that are capable of being stored in a RAM of the memory 255 (e.g., during execution), a ROM of the memory 255 (e.g., on a generally permanent basis), or another non-transitory computer readable medium such as another memory or a disc. Software included in the implementation of the shovel 10 can be stored in the memory 255 of the controller 200. The software includes, for example, firmware, one or more applications, program data, filters, rules, one or more program modules, and other executable instructions. The controller 200 is configured to retrieve from memory and execute, among other things, instructions related to the control processes and methods described herein. In other constructions, the controller 200 includes additional, fewer, or different components.

The power supply module 235 supplies a nominal AC or DC voltage to the controller 200 or other components or modules of the shovel 10. The power supply module 235 is powered by, for example, a power source having nominal line voltages between 100V and 240V AC and frequencies of approximately 50-60 Hz. The power supply module 235 is also configured to supply lower voltages to operate circuits and components within the controller 200 or shovel 10. In other constructions, the controller 200 or other components and modules within the shovel 10 are powered by one or more batteries or battery packs, or another grid-independent power source (e.g., a generator, a solar panel, etc.).

The user interface module 210 is used to control or monitor the power shovel 10. For example, the user interface module 210 is operably coupled to the controller 200 to control the position of the dipper 50, the position of the boom 65, the position of the dipper handle 45, etc. The user interface module 210 includes a combination of digital and analog input or output devices required to achieve a desired level of control and monitoring for the shovel 10. For example, the user interface module 210 includes a display (e.g., a primary display, a secondary display, etc.) and input devices such as touch-screen displays, a plurality of knobs, dials, switches, buttons, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc. The user interface module 210 can also be configured to display conditions or data associated with the power shovel 10 in real-time or substantially real-time. For example, the user interface module 210 is configured to display measured electrical characteristics of the power shovel 10, the status of the power shovel 10, the position of the dipper 50, the position of the dipper handle 45, etc. In some implementations, the user interface module 210 is controlled in conjunction with the one or more indicators 205 (e.g., LEDs, speakers, etc.) to provide visual or auditory indications of the status or conditions of the power shovel 10.

Figure 3:
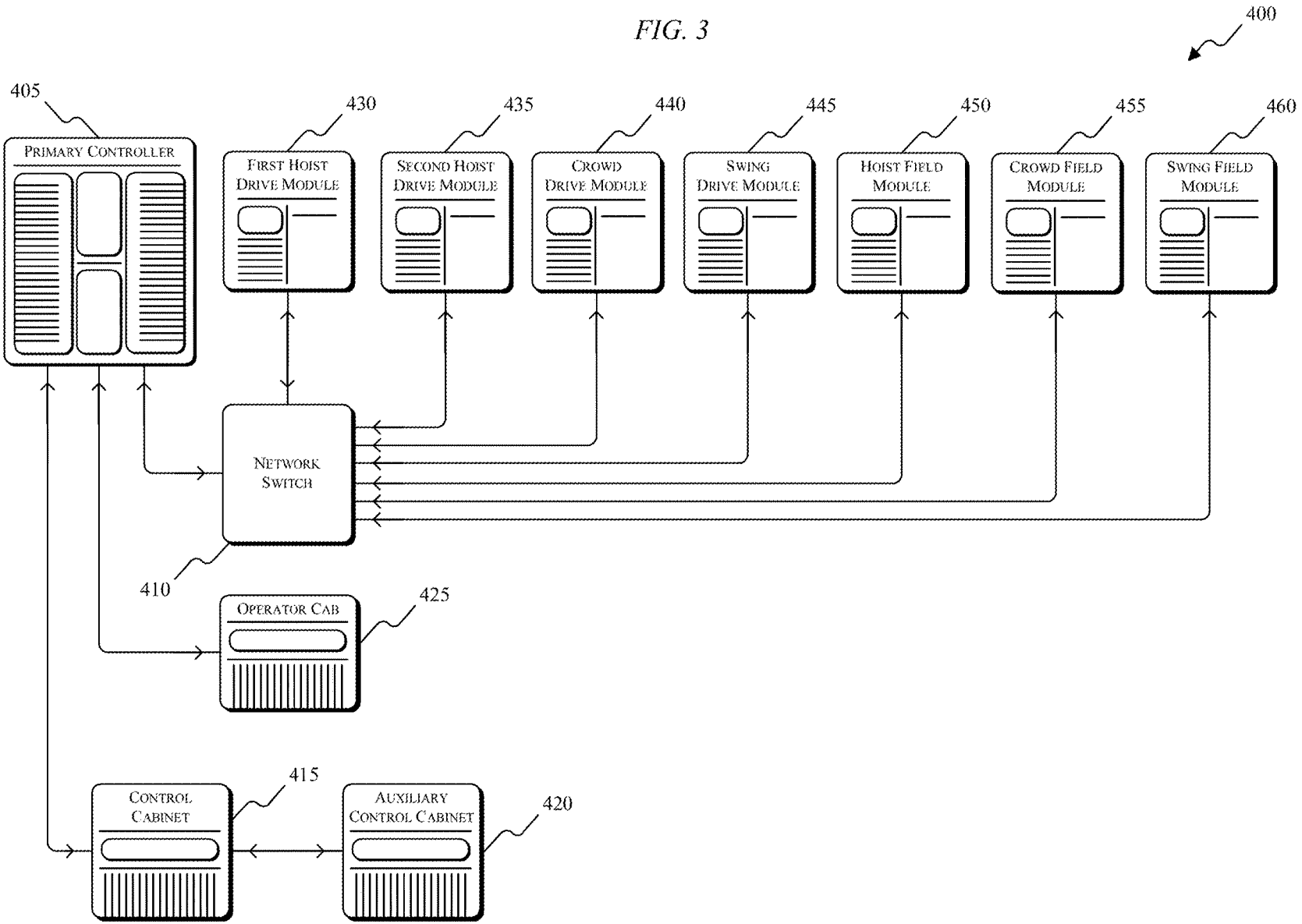
FIG. 3 illustrates a control system of the industrial machine of FIG. 1 according to another embodiment of the invention.

FIG. 3 illustrates a more detailed control system 400 for the power shovel 10. For example, the power shovel 10 includes a primary controller 405, a network switch 410, a control cabinet 415, an auxiliary control cabinet 420, an operator cab 425, a first hoist drive module 430, a second hoist drive module 435, a crowd drive module 440, a swing drive module 445, a hoist field module 450, a crowd field module 455, and a swing field module 460. The various components of the control system 400 are connected by and communicate through, for example, a fiber-optic communication system utilizing one or more network protocols for industrial automation, such as process field bus ("PROFIBUS"), Ethernet, ControlNet, Foundation Fieldbus, INTERBUS, controller-area network ("CAN") bus, etc. The control system 400 can include the components and modules described above with respect to FIG. 2. For example, the one or more hoist actuators and/or drives 215 correspond to first and second hoist drive modules 430 and 435, the one or more crowd actuators and/or drives 220 correspond to the crowd drive module 440, and the one or more swing actuators and/or drives 225 correspond to the swing drive module 445. The user interface 210 and the indicators 205 can be included in the operator cab 425, etc. A strain gauge, an inclinometer, gantry pins, resolvers, etc., can provide electrical signals to the primary controller 405, the controller cabinet 415, the auxiliary cabinet 420, etc.

The first hoist drive module 430, the second hoist drive module 435, the crowd drive module 440, and the swing drive module 445 are configured to receive control signals from, for example, the primary controller 405 to control hoisting, crowding, and swinging operations of the shovel 10. The control signals are associated with drive signals for hoist, crowd, and swing actuators 215, 220, and 225 of the shovel 10. As the drive signals are applied to the actuators 215, 220, and 225, the outputs (e.g., electrical and mechanical outputs) of the actuators are monitored and fed back to the primary controller 405 (e.g., via the field modules 450-460). The outputs of the actuators include, for example, speed, torque, power, current, pressure, etc. Based on these and other signals associated with the shovel 10, the primary controller 405 is configured to determine or calculate one or more operational states or positions of the shovel 10 or its components. In some embodiments, the primary controller 405 determines a dipper position, a dipper handle angle or position, a hoist rope wrap angle, a hoist motor rotations per minute ("RPM"), a crowd motor RPM, a dipper speed, a dipper acceleration, etc.

The controller 200 and/or the control system 400 of the shovel 10 described above are used to control the operation of the industrial machine 10 based on, for example, a comparison of an actual parameter of the industrial machine (e.g., a crowd parameter) to an operator-requested parameter (e.g., an operator-requested crowd parameter). The controller 200 is configured to determine, for example, whether a crowd runaway condition has been detected based on the comparison of an actual parameter and the requested parameter. When a crowd runaway condition is determined or identified, the controller 200 or the control system 400 are configured to control the performance of the industrial machine (e.g., a torque, a motor speed, a motor current, etc.) based on the comparison of the actual and requested parameters.

Three examples of such control are set forth with respect to processes 500, 600, and 700 described below. The processes 500, 600, and 700 are associated with and described herein with respect to a digging operation and forces (e.g., crowd forces, etc.) applied during the operation. Various steps described herein with respect to the processes 500, 600, and 700 are capable of being executed simultaneously, in parallel, or in an order that differs from the illustrated serial manner of execution. The processes 500, 600, and 700 are also each capable of being executed using fewer steps than are shown in the illustrated embodiment. For example, one or more functions, formulas, or algorithms can be used to calculate a necessary retract torque or other crowd parameter to resolve a crowd runaway condition.

Figure 4:
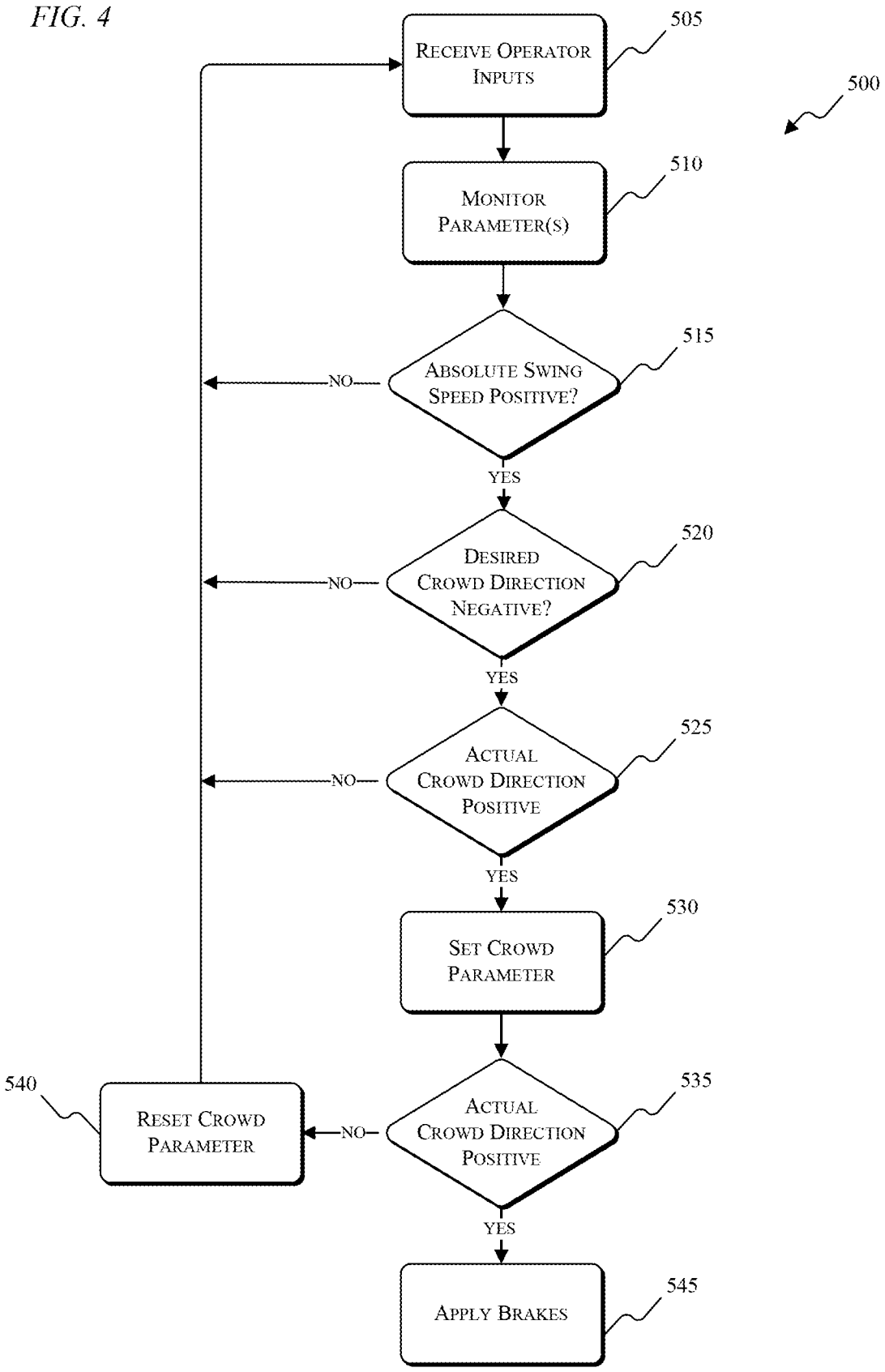
FIG. 4 is a process for controlling a parameter of an industrial machine according to an embodiment of the invention.

As illustrated in FIG. 4, the process 500 begins at step 505 with the controller 200 receiving operator inputs for the industrial machine 10 via the user interface 210. The operator inputs can include a requested crowd, hoist, and/or swing parameter (e.g., velocity, speed, direction, torque, current, etc.). For example, a requested crowd parameter can include a requested position of the dipper 50 in a crowding direction, a requested speed of the crowd motor 220, or a retract torque of the crowd motor 220, among other potential requested parameters of the crowd system. Requested swing parameters can include a requested swing speed of the dipper handle 45 or a requested swing direction/position of the dipper handle 45, among other potential requested parameters of the swing system. Based on the operator inputs (i.e., requested parameters), the controller 200 generates drive signals, as described above, for the hoist, crowd, and swing actuators 215, 220, and 225. At step 510, the corresponding outputs (e.g., voltage, current, position, power, torque, speed, etc.) of the actuators 215, 220, 225 or other sensors of the industrial machine (e.g., resolvers, inclinometers, etc.) are then monitored and fed back to the controller 200.

Swing parameters that can be monitored include an absolute swing speed, such as the swing speed of the dipper 50 and dipper handle 45. Additionally or alternatively, swing speed can be determined based on monitored motor parameters or using other sensors. The absolute swing speed (e.g., absolute value of swing speed) can describe either positive or negative (i.e., greater than zero or less than zero) movement depending on the direction of rotation of the swing motor 225. If, at step 515, the absolute swing speed is determined to be zero, the process 500 returns to step 505 and receives an updated set of operator inputs for steps 510-515. However, if the absolute swing speed is determined to be positive (i.e., swinging), the controller 200 determines whether the operator-requested parameter (e.g., operator crowd input parameter) corresponds to a value that is less than approximately zero or greater than approximately zero (at step 520). For example, in the embodiment of FIG. 4, the requested crowd parameter refers to a requested dipper position, speed, or direction of movement of the dipper. An operator requested parameter corresponding to a negative value (i.e., a value less than zero) corresponds to a direction of movement of the dipper 50 toward the industrial machine 10. An operator requested parameter corresponding to a positive value (i.e., a value greater than zero) corresponds to a direction of movement of the dipper 50 away from the industrial machine 10.

If, at step 520, the requested direction of movement of the dipper is determined to correspond to a positive value (such that the operator is extending the dipper 50 away from the machine 10), the process 500 returns to step 505. However, if the requested direction of movement of the dipper corresponds to a negative value (such that the operator is attempting to retract the dipper 50 toward the machine 10), the controller 200 determines whether the corresponding actual direction of movement of the dipper is positive or negative (at step 525). If the actual direction of movement of the dipper is negative, in accordance with the requested movement, the process 500 returns to step 505 because the actual crowd system performance is determined to be in accordance with the operator's requested performance. However, if the actual direction of movement of the dipper is positive, such that the dipper 50 is behaving contrary to the operator's requested input, the controller 200 determines a crowd runaway condition is present and sets a crowd parameter (e.g., a crowd torque, a crowd retract torque, a crowd force, etc.) to resolve the crowd runaway condition (at step 530).

The value for the crowd parameter can be set to a predetermined value or to a value that is determined as a proportion of the magnitude of the difference between the actual and requested performance with respect to a normal operating value. For example, a torque (e.g., a retract torque) can be increased to a certain percentage or ratio of the normal operating torque (e.g., greater than 100% of a normal operating torque, to 100-150% of the normal operating torque, up to 300% of the normal operating torque, etc.). The percentage or ratio can either be a predetermined fixed value, such as can be applied to all crowd runaway conditions regardless of the magnitude of difference between the actual and requested crowd parameters, or the percentage or ratio can be determined (e.g., calculated) proportionally to the magnitude of the difference between the actual and requested parameters.

At step 535, the controller 200 determines if the crowd runaway condition has been cleared by determining if the actual direction of movement of the dipper 50 is negative in accordance with the requested direction of movement of the dipper 50. If the actual direction of movement of the dipper 50 is determined to be negative and the crowd runaway condition has been cleared, the controller 200 resets the crowd parameter to the previous or normal value for the crowd parameter (at step 540). However, if the controller 200 determines that the actual direction of movement of the dipper 50 is still positive and the crowd runaway condition has not been resolved by adjusting the crowd parameter, the controller 200 can set the brakes for one or more of the crowd, swing, or hoist actuators 215, 220, 225 (at step 545).

Figure 5:
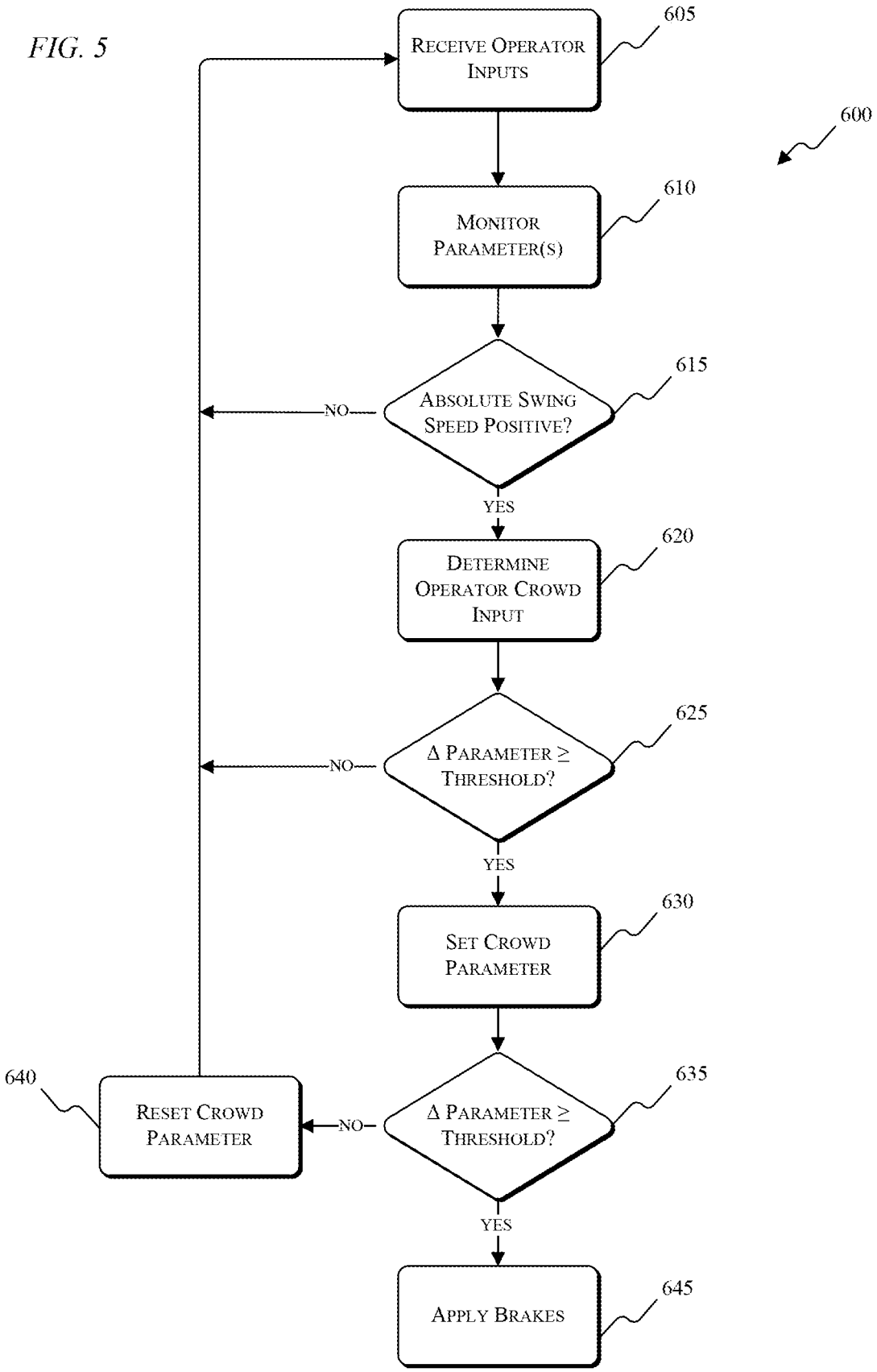
FIG. 5 is a process for controlling a parameter of an industrial machine according to another embodiment of the invention.

In some embodiments, actual and requested crowd system behavior can be monitored based on whether the difference between the actual and requested parameters exceeds a threshold value (as opposed to whether the directionality or positive/negative indication of the actual parameter matches that of the requested parameter, such as in the process 500). As illustrated in FIG. 5, the process 600 begins at step 605 with the controller 200 receiving operator inputs for the industrial machine 10 via the user interface 210. As explained above with regard to the process 500, the operator inputs can include a requested crowd, hoist, and/or swing parameter (e.g., velocity, speed, direction, torque, position, current, pressure, etc.). Based on the operator inputs (i.e., requested parameters), the controller 200 generates drive signals, as described above, for the hoist, crowd, and swing actuators 215, 220, and 225. At step 610, the corresponding outputs (e.g., voltage, current, power, torque, speed, etc.) of the actuators 215, 220, and 225 or other sensors of the industrial machine (e.g., resolvers, inclinometers, etc.) are then monitored and fed back to the controller 200.

If, at step 615, the absolute swing speed is determined to be zero, the process 600 returns to step 605 and receives an updated set of operator inputs for steps 610-615. However, if the absolute swing speed is determined to be positive (i.e., swinging), the controller 200 determines the operator-requested parameter (i.e., operator crowd input parameter) (at step 620). Similar to the process 500, the requested crowd parameter in the embodiment of the process 600 can refer to a requested dipper position, speed, or direction of movement of the dipper 50.

At step 625, the controller 200 determines whether the difference between the requested crowd parameter and the corresponding actual crowd parameter has reached or exceeded a determined threshold value (at step 625). The threshold value can be defined as an upper limit of an absolute margin of error between the operator's requested crowd parameter and the actual crowd parameter. Further, the threshold value can be a fixed, predetermined value, or a value that is determined (e.g., calculated) based on certain factors including a current swing and/or hoist speed, a size of the dipper payload, etc. For example, the threshold value can be decreased for high swing speeds and/or heavier payloads, such that a runaway condition can be detected and controlled with greater sensitivity for higher-risk digging scenarios. If the difference meets or exceeds the threshold value, the controller 200 determines a crowd runaway condition is present and sets a crowd parameter (e.g., a torque) to resolve the crowd runaway condition (at step 630).

As described above with respect to the process 500, the value for the crowd parameter can be set to a predetermined value or to a value that is determined as a proportion of the magnitude of difference between the actual and requested performance with respect to a normal operating value. For example, a torque (e.g., a retract torque) can be increased to a certain percentage or ratio of the normal operating torque (e.g., greater than 100% of a normal operating torque, to 100-150% of the normal operating torque, up to 300% of the normal operating torque, etc.). The percentage or ratio can either be a predetermined fixed value, such as can be applied to all crowd runaway conditions regardless of the magnitude of difference between the actual and requested crowd parameters, or the percentage or ratio can be determined (e.g., calculated) proportionally to the magnitude of difference between the actual and requested parameters.

At step 635, the controller 200 determines if the crowd runaway condition has been cleared by determining if the determined difference has been adjusted to a value below the threshold. If the difference is below the threshold and the crowd runaway condition has been cleared, the controller 200 resets the crowd parameter to the previous or normal operating value (at step 640). However, if the controller 200 determines that the difference is still equivalent to or exceeding the threshold and the crowd runaway condition has not been resolved, the controller 200 can set the brakes for one or more of the crowd, swing, or hoist actuators 215, 220, 225 (at step 645).

Figure 6:
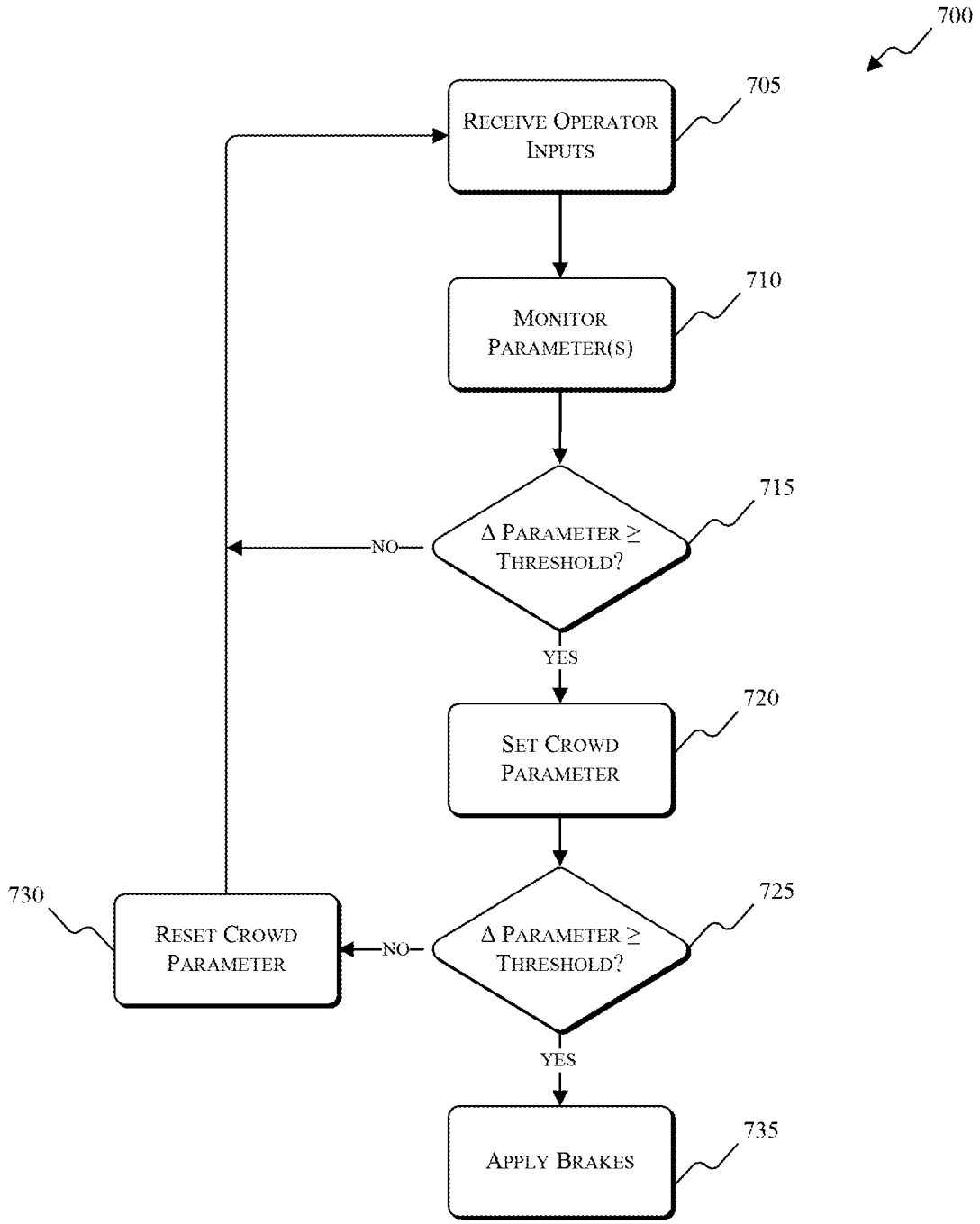
FIG. 6 is a process for controlling a parameter of an industrial machine according to another embodiment of the invention.

Similar to the process 600, in the process 700 of FIG. 6 the actual and requested crowd system behavior can be monitored based on whether the difference between the actual and requested parameters exceeds a threshold value. The process 700 begins at step 705 with the controller 200 receiving operator inputs for the industrial machine 10 via the user interface 210. As explained above with regard to the processes 500 and 600, the operator inputs can include a requested crowd, hoist, and/or swing parameter (e.g., velocity, speed, direction, torque, current, position, pressure, etc.). Based on the operator inputs (i.e., requested parameters), the controller 200 generates drive signals, as described above, for the hoist, crowd, and swing actuators 215, 220, and 225. At step 710, the corresponding outputs of the actuators 215, 220, and 225, or other sensors of the industrial machine (e.g., resolvers, inclinometers, etc.), are then monitored and fed back to the controller 200.

At step 715, the controller 200 determines whether the difference between the requested crowd parameter and the corresponding actual crowd parameter has reached or exceeded a determined threshold value. The threshold value can be defined as an upper limit of an absolute margin of error between the operator's requested crowd parameter and the actual crowd parameter. Further, the threshold value can be a fixed, predetermined value, or a value that is determined (e.g., calculated) based on certain factors including a current swing and/or hoist speed, a size of the dipper payload, etc. For example, the threshold value can be decreased for high swing speeds and/or heavier payloads, such that a runaway condition can be detected and controlled with greater sensitivity for higher-risk digging scenarios. If the difference meets or exceeds the threshold value, the controller 200 determines a crowd runaway condition is present and sets a crowd parameter (e.g., a torque) to resolve the crowd runaway condition (at step 720).

As described above with respect to the processes 500 and 600, the value for the crowd parameter can be set to a predetermined value or to a value that is determined as a proportion of the magnitude of difference between the actual and requested crowd parameters with respect to a normal operating value. For example, a torque (e.g., a retract torque) can be increased to a certain percentage or ratio of the normal operating torque (e.g., greater than 100% of a normal operating torque, to 100-150% of the normal operating torque, up to 300% of the normal operating torque, etc.). The percentage or ratio can either be a predetermined fixed value, such as can be applied to all crowd runaway conditions regardless of the magnitude of difference between the actual and requested crowd parameters, or the percentage or ratio can be determined (e.g., calculated) proportionally to the magnitude of difference between the actual and requested parameters.

At step 725, the controller 200 determines if the crowd runaway condition has been cleared by determining if the determined difference has been adjusted to a value below the threshold. If the difference is below the threshold and the crowd runaway condition has been cleared, the controller 200 resets the crowd parameter to the previous or normal operating value (at step 730). However, if the controller 200 determines that the difference is still equivalent to or exceeding the threshold and the crowd runaway condition has not been resolved, the controller 200 can set the brakes for one or more of the crowd, swing, or hoist actuators 215, 220, 225 (at step 735).

Additionally or alternatively, crowd runaway conditions can be controlled by adjusting one or more parameters of the industrial machine other than a crowd parameter (e.g., swing parameters or hoist parameters). For example, if a dipper runaway occurs in a crowding direction, such that the operator is unable to control the dipper 50 to achieve a requested dipper position, the controller 200 can reduce a swing speed of the industrial machine 10. Reducing the swing speed of the industrial machine 10 reduces the centrifugal forces on the dipper 50, allowing the dipper 50 to be more easily controlled by the operator's requests. Comparisons similar to those described above with respect to the crowd parameter can be applied to, for example, hoist or swing parameters for identifying and controlling crowd runaway conditions.

Thus, the invention provides, among other things, systems, methods, devices, and computer readable media for controlling crowd runaway conditions of an industrial machine based on a comparison of an actual crowd parameter and a requested crowd parameter.

What is claimed is:

1. An industrial machine comprising:

a dipper;

a sensor operable to generate a first signal related to an actual crowd parameter;

a user interface operable to generate a second signal related to a requested crowd parameter based on an operator input;

a crowd motor having at least one operating parameter; and a controller configured to receive the first signal related to the actual crowd parameter, receive the second signal related to the requested crowd parameter, determine a difference between the requested crowd parameter and the actual crowd parameter, compare the difference between the requested crowd parameter and the actual crowd parameter to a threshold, and set the at least one operating parameter of the crowd motor to a value when the difference is greater than or equal to the threshold, the value being greater than a normal operating value for the operating parameter.

2. The industrial machine of claim 1, wherein the requested crowd parameter includes at least one of a requested crowd motor direction, a requested crowd motor current, or a requested crowd motor speed.

3. The industrial machine of claim 1, wherein the actual crowd parameter includes at least one of an actual crowd motor direction, an actual crowd motor current, or an actual crowd motor speed.

4. The industrial machine of claim 1, wherein the at least one operating parameter is a crowd retract torque.

5. The industrial machine of claim 4, wherein, when the difference is greater than or equal to the threshold, the value for the crowd retract torque is calculated based on a ratio of the actual crowd parameter and the requested crowd parameter.

6. The industrial machine of claim 4, wherein, when the difference is greater than or equal to the threshold, the value for the crowd retract torque is calculated based on a function of the difference.

7. The industrial machine of claim 6, wherein the controller is configured to apply brakes to the crowd motor.

8. A method of controlling a motor of an industrial machine, the method comprising:

receiving, at a processor, a first signal related to an actual crowd parameter;

receiving, at the processor, a second signal related to a requested crowd parameter;

determining, with the processor, a difference between the requested crowd parameter and the actual crowd parameter;

comparing, with the processor, the difference between the requested crowd parameter and the actual crowd parameter to a threshold; and setting, with the processor, the at least one operating parameter of the motor to a value when the difference is greater than or equal to the threshold, the value being greater than a normal operating value for the operating parameter.

9. The method of claim 8, wherein the first signal is received from a user interface based on an operator input.

10. The method of claim 8, wherein the requested crowd parameter includes at least one of a requested crowd motor direction, a requested crowd motor current, or a requested crowd motor speed.

11. The method of claim 8, wherein the actual crowd parameter includes at least one of an actual crowd motor direction, an actual crowd motor current, or an actual crowd motor speed.

12. The method of claim 8, wherein the motor is a crowd motor and the at least one operating parameter is a crowd retract torque.

13. The method of claim 12, further comprising calculating the value for the crowd retract torque based on a ratio of the actual crowd parameter and the requested crowd parameter when the difference is greater than or equal to the threshold.

14. The method of claim 12, further comprising calculating the value for the crowd retract torque based on a function of the difference when the difference is greater than or equal to the threshold.

15. The method of claim 14, further comprising applying, with the processor, brakes to the crowd motor.

* * * * *